US008891983B2

(12) United States Patent
Tamagaki et al.

(10) Patent No.: US 8,891,983 B2
(45) Date of Patent: Nov. 18, 2014

(54) IMAGE FORMING APPARATUS HAVING WASTE DEVELOPER CONTROL

(75) Inventors: Kuniaki Tamagaki, Kawasaki (JP); Masahiro Yoshida, Tokyo (JP); Koichiro Takashima, Fujisawa (JP); Nobuo Oshima, Kawasaki (JP); Kohei Matsuda, Fujisawa (JP); Takashi Mukai, Kawasaki (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 13/569,435

(22) Filed: Aug. 8, 2012

(65) Prior Publication Data

US 2013/0039671 A1 Feb. 14, 2013

(51) Int. Cl.

| | |
|---|---|
| ***G03G 15/16*** | (2006.01) |
| ***G03G 21/00*** | (2006.01) |
| ***G03G 21/12*** | (2006.01) |
| ***G03G 15/08*** | (2006.01) |
| ***G03G 15/00*** | (2006.01) |

(52) U.S. Cl.

CPC ..... *G03G 15/086* (2013.01); *G03G 2221/183* (2013.01); *G03G 15/556* (2013.01)

USPC ..... 399/35; 399/27

(58) Field of Classification Search

CPC ..... G03G 15/0856; G03G 15/086; G03G 15/0862; G03G 15/16; G03G 15/50; G03G 15/553; G03G 15/556; G03G 21/10; G03G 21/12

USPC ..... 399/35, 358, 360, 27, 34

See application file for complete search history.

(56) References Cited

U.S. PATENT DOCUMENTS

| | | | | |
|---|---|---|---|---|
| 7,689,156 | B2 * | 3/2010 | Shishikura | 399/358 |
| 2009/0010659 | A1 * | 1/2009 | Watanabe | 399/27 |
| 2011/0026948 | A1 * | 2/2011 | Nagasu et al. | 399/35 |

FOREIGN PATENT DOCUMENTS

| | | | |
|---|---|---|---|
| JP | 63-247783 | A | 10/1988 |
| JP | 2003-316224 | A | 11/2003 |

OTHER PUBLICATIONS

Machine translation of JP 2003-316224 dated Jan. 6, 2014.*

* cited by examiner

*Primary Examiner* — Sophia S Chen

(74) *Attorney, Agent, or Firm* — Fitzpatrick, Cella, Harper & Scinto

(57) ABSTRACT

An image forming apparatus includes an image bearing member, a developer container, a first calculator, and a second calculator. The first calculator calculates an amount of the developer supplied to the image bearing member from the developer container, on the basis of an amount of the developer measured by a measuring device after an image forming operation, and an amount of the developer initially contained in the developer container. A controller outputs an information signal relating to the developer amount accumulated in the collection container on the basis of the amount of the developer calculated by the first calculator and the amount of the developer calculated by the second calculator.

21 Claims, 7 Drawing Sheets

(a)

(b)

IMAGE FORMING APPARATUS HAVING WASTE DEVELOPER CONTROL

FIELD OF THE INVENTION AND RELATED ART

The present invention relates to an image forming apparatus equipped with a container in which the developer remaining on the image bearing member of the apparatus is recovered.

There have been known image forming apparatuses having: a transferring device which transfers a toner image (developer image) formed on the photosensitive drum (image bearing member) of the apparatus, onto a sheet of recording medium such as paper; and a cleaning device which removes the toner remaining on the peripheral surface of the photosensitive drum after the transfer of the toner image. Generally speaking, a developing device has: a toner container (developer container) for storing toner (developer); and a development sleeve (developer bearing member) which supplies the peripheral surface of the photosensitive drum with the toner in the toner container. A cleaning device has: a cleaning blade which is placed in contact with the peripheral surface of the photosensitive drum to scrape away the toner remaining on the peripheral surface of the photosensitive drum; and a container into which the toner (which hereafter may be referred to waste toner) removed (scraped away) by the cleaning blade is recovered. If waste toner is generated by an amount greater than the capacity of the waste toner collection container, it sometimes occurs that the waste toner spills from the waste toner collection container. If the waste toner spills from the waste toner collection container, it is possible that the image forming apparatus will output unsatisfactory images, the flaws of which are attributable to the waste toner having spilled from the waste toner recover container. Thus, Japanese Laid-open Patent Application 2003-316224 discloses an image forming apparatus which calculates the amount of the waste toner it generates, based on the amount of its toner consumption, and its transfer efficiency. This apparatus calculates the amount by which waste toner is generated, and as it determines when the container would have been filled up with the waste toner, it warns a user that the container will be about to be full, preventing thereby the waste toner from spilling from the waste toner container. In the above-mentioned patent document (which hereafter may be referred to as first patent document), the amount of toner consumption means the amount by which toner transfers onto the area (which hereafter may be referred to as exposed area) of the peripheral surface of the photosensitive drum, from the toner container. The transfer efficiency means the ratio with which the toner supplied to the image formation area of the photosensitive drum is transferred onto a sheet of paper or the like. That is, according to the first patent document, it is possible to obtain the amount of transfer residual toner on the photosensitive drum, that is, the amount of the toner remaining on the peripheral surface of the photosensitive drum after the toner image transfer, by calculating the difference between the amount of toner consumption, that is, the amount by which the toner is supplied to the image formation area of the photosensitive drum, and the amount by which toner is transferred from the image formation area of the photosensitive drum onto a sheet of paper or the like. Thus, it is possible to calculate the amount by which the waste toner is recovered into the waste toner collection container.

However, the waste toner, which is to be recovered into the waste toner collection container, is not the transfer residual toner alone. It includes the toner which transfers onto the peripheral surface of the photosensitive drum, but does not contribute to image formation, that is, the toner which is consumed during an image forming operation, but remains adhered to the areas of the peripheral surface of the photosensitive drum, which correspond to the blank portions of the image to be formed (which hereafter may be referred to as unexposed portions). Hereafter, the toner that adheres to the unexposed portions of the peripheral surface of a photosensitive member will be referred to as "stray toner". The first patent document 1 does not take the stray toner into consideration. In a case where an image which is low in print ratio is outputted, the exposed portion of the image formation area of the photosensitive drum becomes greater in size than the unexposed portion of the image formation area, and therefore, the amount of the stray toner, that is, the toner that adheres to the unexposed portion is substantial. That is, the amount of the stray toner is unignorable when calculating the amount of the waste toner. In other words, if the amount of waste toner is calculated simply calculating the amount of the transfer residual toner, that is, without taking the amount of the stray toner into consideration, the calculated (estimated) amount by which the waste toner is recovered into the waste toner collection container is substantially different from the actual amount, making it impossible to accurately determine whether or not the waste toner collection container has been filled up with the waste toner.

SUMMARY OF THE INVENTION

Thus, the primary object of the present invention is to provide an image forming apparatus which is capable of taking into consideration the developer having adhered to the unexposed portion of the image formation area of its image bearing member, and therefore, is capable of accurately calculating the amount by which the developer is removed by its cleaning member and accumulated in its waste toner collection container.

According to an aspect of the present invention, there is provided an image forming apparatus comprising an image bearing member; an exposure device for forming an electrostatic latent image on said image bearing member by exposure to light; a developing device including a developer container for containing a developer, and a developer carrying member for forming a developed image on said image bearing member by visualizing the electrostatic latent image by supplying the developer contained in said developer container to said image bearing member; a transferring device for transferring the developed image onto a recording material an intermediary transfer member; a cleaning device including a cleaning member for removing the developer remaining on said image bearing member after transfer of the developed image, a collection container for collecting the developer removed by said cleaning member; a measuring device for measuring an amount of the developer in said developer container; first calculating means for calculating an amount of the developer supplied from said developer container to said image bearing member; second calculating means for calculating an amount of the developer transferred onto the recording material or the intermediary transfer member; and a controller for outputting an information signal relating to a developer amount accumulated in said collection container on the basis of an amount of the developer calculated by said first calculating means and an amount of the developer calculated by said second calculating means, wherein said first calculating means calculates an amount of the developer supplied to said image bearing member from an inside of said developer container, on the basis of an amount of the developer measured by said measuring device after an image forming operation, and an amount of the developer initially contained in said developer container, and said controller outputs the information signal relating to the developer amount accumulated in said collection container on the basis of the amount of the developer calculated by said first calculating means and the amount of the developer calculated by said second calculating means.

According to the present invention, it is possible to accurately calculate the amount of the developer having been removed by the cleaning member of an image forming apparatus and having accumulated in the waste toner collection container of the image forming apparatus.

These and other objects, features, and advantages of the present invention will become more apparent upon consideration of the following description of the preferred embodiments of the present invention, taken in conjunction with the accompanying drawings.

Figure 6:
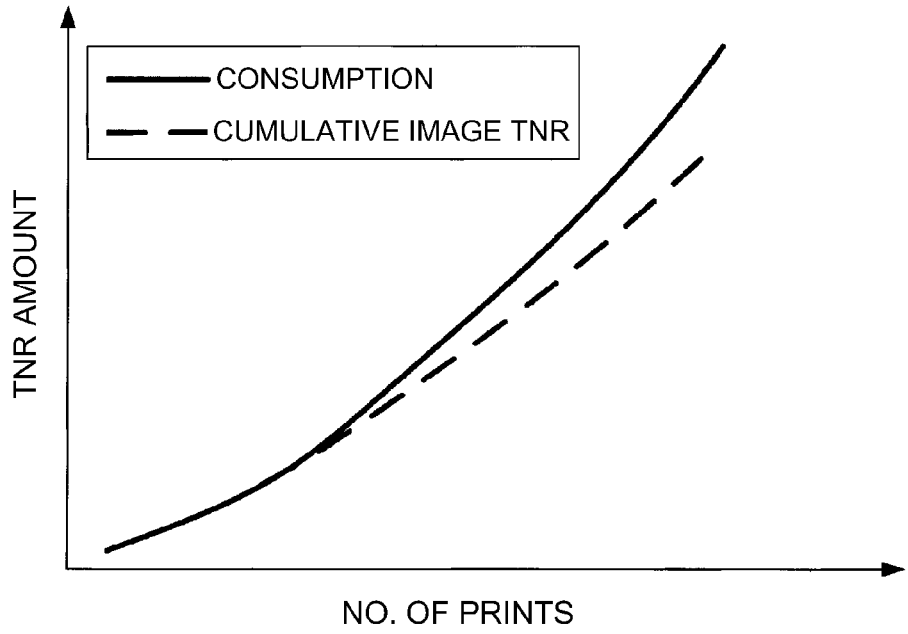
Figure 6:
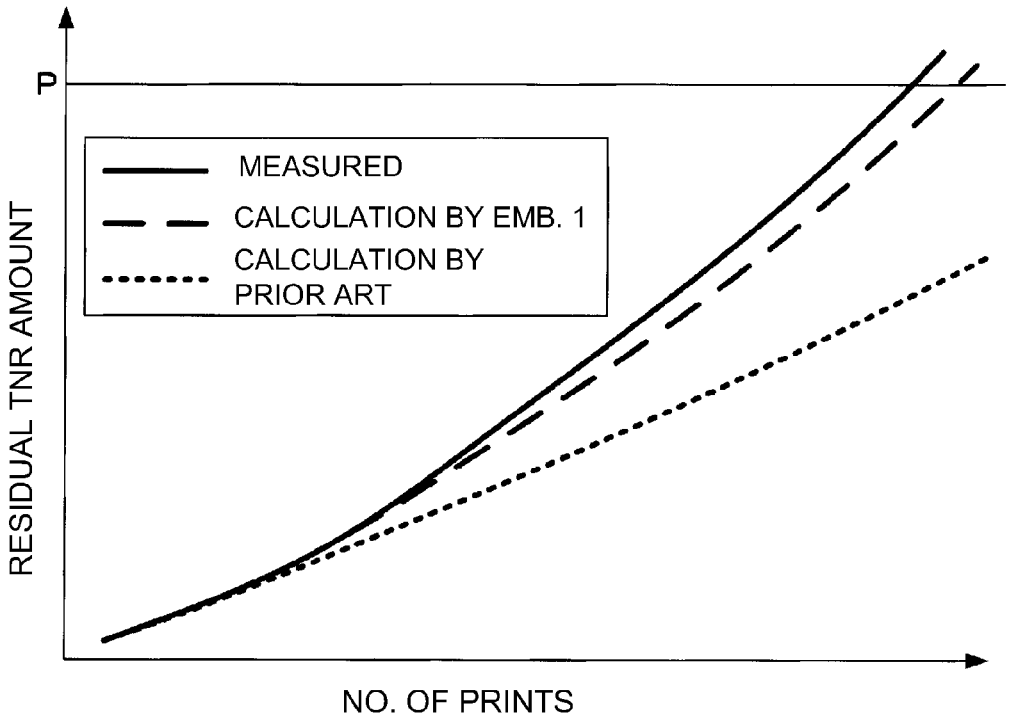

Parts (a) and (b) of FIG. 6 are graphs for showing the changes in the relationship between the overall amount of toner consumption and the actual amount by which toner is used for image formation.

Figure 7:
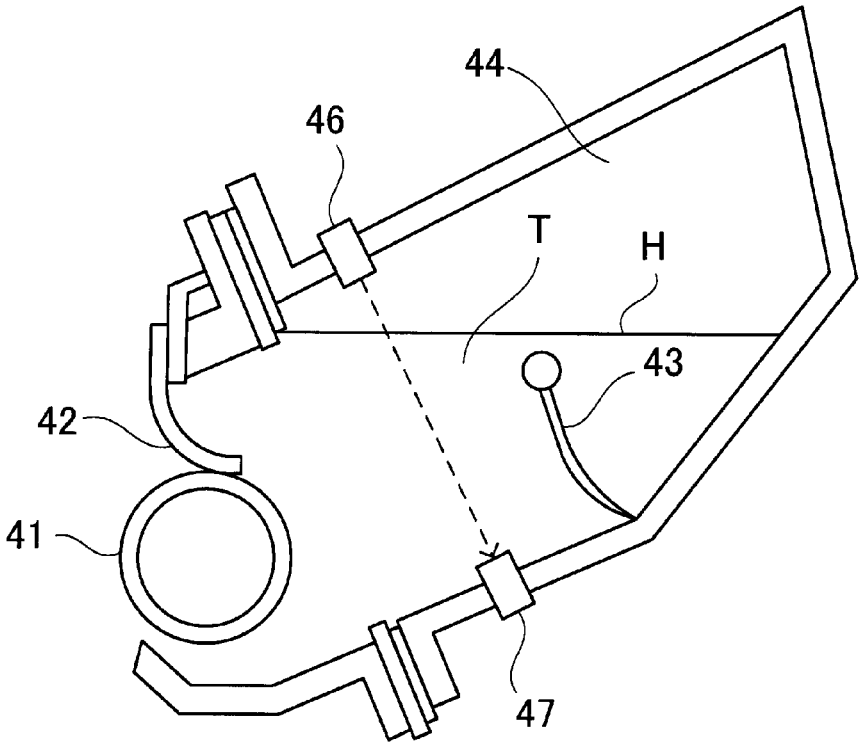

FIG. 7 is a drawing for describing the method for detecting the residual amount of the toner in the toner container, in the second embodiment of the present invention.

DESCRIPTION OF THE PREFERRED EMBODIMENTS

Embodiment 1

Figure 1:
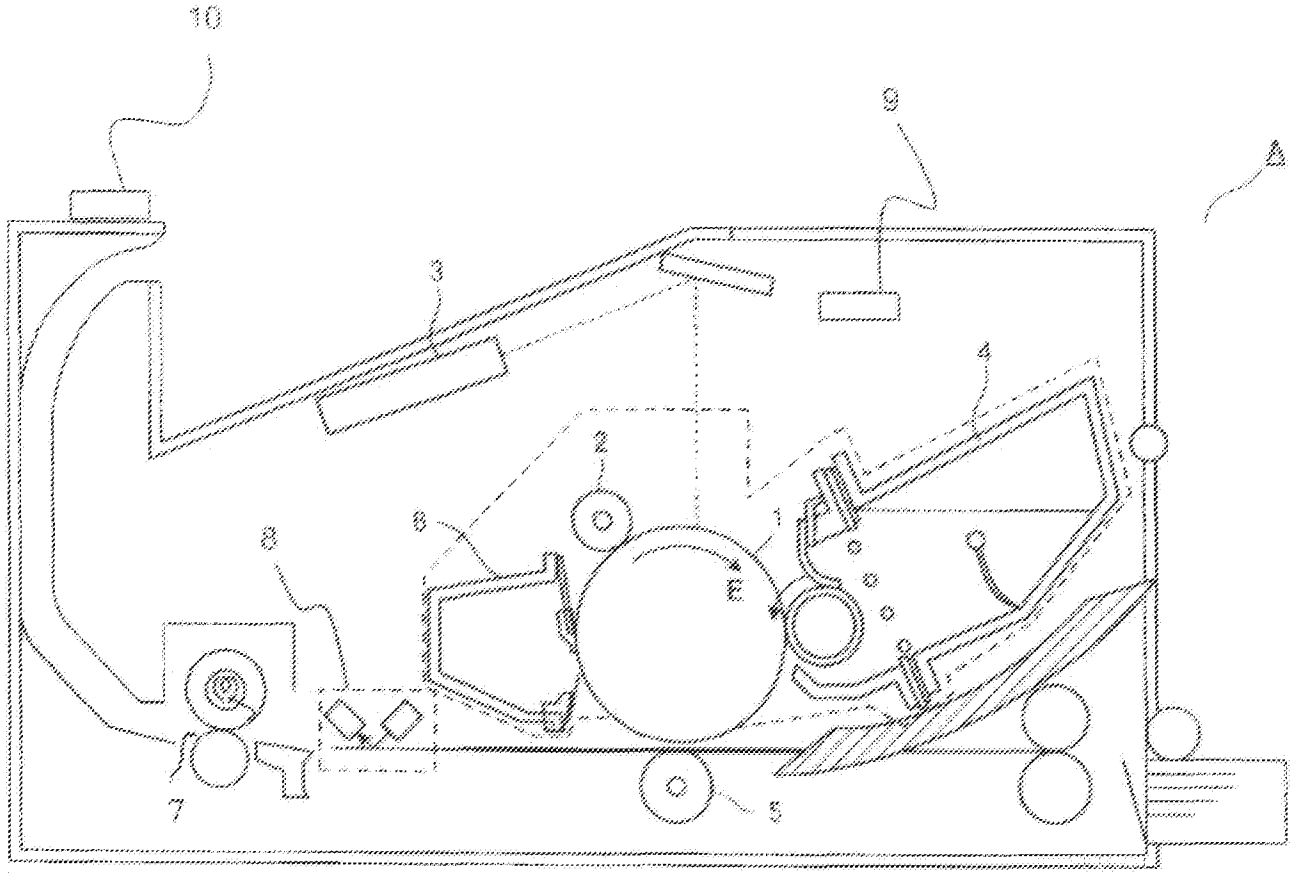
FIG. 1 is a schematic sectional view of the image forming apparatus in the first embodiment of the present invention.
Figure 2:
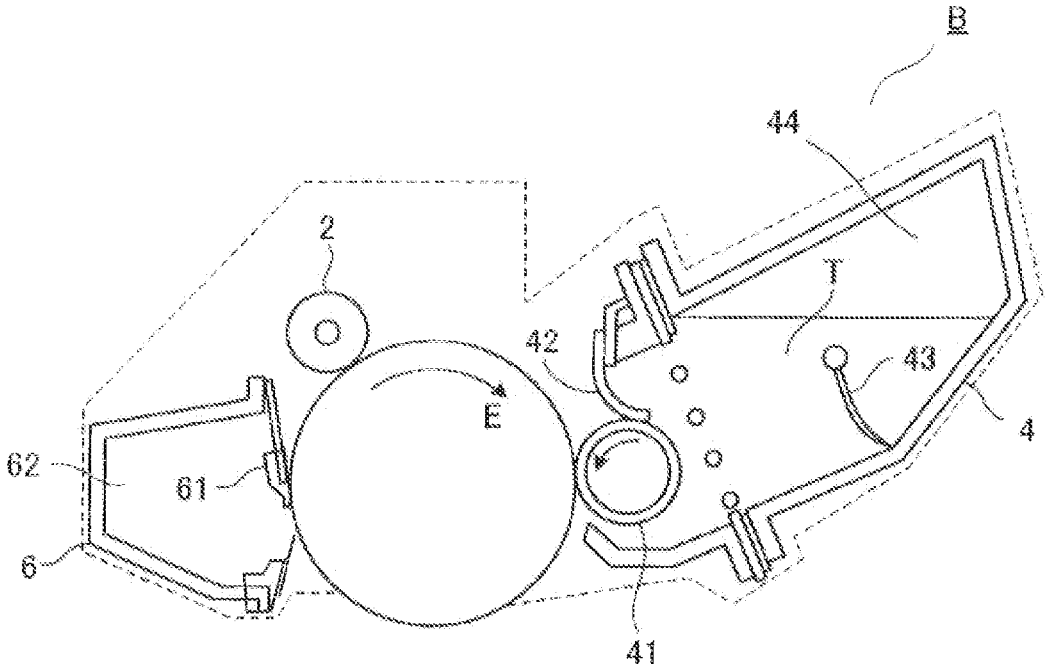
FIG. 2 is an enlarged sectional view of the process cartridge installable in the image forming apparatus in the first embodiment.

First, referring to FIG. 2, the image forming apparatus in the first embodiment of the present invention is described regarding its general structure. FIG. 1 is a schematic sectional view of the image forming apparatus in the first embodiment. FIG. 2 is an enlarged sectional view of the process cartridge installable in the image forming apparatus in the first embodiment. The image forming apparatus in the first embodiment is structured so that a process cartridge B is removably installable in the main assembly A of the apparatus. This embodiment, however, is not intended to limit the present invention in terms of the structure of an image forming apparatus. That is, the present invention is also applicable to an image forming apparatus, all the components (including the process cartridge) of which are integral parts of the main assembly A of the apparatus.

The image forming apparatus in the first embodiment has: a photosensitive drum 1 as an image bearing member; a charging device 2; an exposing device 3, a developing device 4; a transferring device 5; a cleaning device 6; and a fixing device 7. The photosensitive drum 1 rotates in the direction indicated by an arrow mark E in FIG. 1. The charging device 2 is placed in contact with the photosensitive drum 1, and is rotated by the rotation of the photosensitive drum 1 while a preset charge bias is applied to the device 2. The exposing device 3 projects a beam of laser light while modulating the beam with image formation signals. The developing device 4 has: a development sleeve 41 as a developer bearing member; a development blade 42; and a toner container 44, as a developer container, having a member 43 which conveys toner (developer) while stirring the toner. The development sleeve 41 is positioned so that its peripheral surface faces the opening of the developing device 4, and is in contact with the photosensitive drum 1 by its portion exposed through the opening. The development sleeve 41 bears toner by its peripheral surface, and rotates in such a direction that its peripheral surface and the peripheral surface of the photosensitive drum 1 move in the same direction, in the area of contact between the development sleeve 41 and photosensitive drum 1, at such a peripheral velocity that is preset in ratio relative to the peripheral velocity of the photosensitive drum 1. The stirring/conveying member 43 conveys the toner in the toner container 44 (developer container) while stirring the toner. The cleaning device 6 has a cleaning blade as a cleaning member, and a waste toner collection container 62 (which hereafter will be referred to simply as collection container). Referring to FIG. 2, the process cartridge B is removably installable in the main assembly A of the image forming apparatus. It integrally holds the photosensitive drum 1, charging device 2, developing device 4, and a cleaning device 6. It has also a nonvolatile memory (unshown), which is for storing the information regarding the history of the usage of the process cartridge B, for example, the cumulative number of images formed, cumulative number of rotations of the photosensitive drum 1, etc. The image forming apparatus is provided with a communicating means (unshown) through which the apparatus reads or writes (rewrites) the history of the usage of the process cartridge in the memory.

Next, the image forming operation of the image forming apparatus in the first embodiment is briefly described. First, the charge device 2 uniformly charges the peripheral surface of the photosensitive drum 1 to a preset potential level. Then, the exposing device 3 forms an electrostatic latent image on the uniformly charged peripheral surface of the photosensitive drum 1 (image bearing member), by projecting a beam of laser light upon the peripheral surface of the photosensitive drum 1. Meanwhile the toner in the toner container 44 is conveyed onto the development sleeve 41 by the stirring/conveying member 43, forming thereby a layer of toner on the peripheral surface of the development sleeve 41. Then, as the development sleeve 41 rotates, the toner layer is frictionally charged between the peripheral surface of the development sleeve 41 and development blade 42. The image forming apparatus in this embodiment is designed so that the toner is to move onto the positively charged surface, in the development and transfer processes. Thus, the toner is negatively charged. The development sleeve 41 bearing the toner develops the electrostatic latent image onto a visible image by supplying the peripheral surface of the photosensitive drum 1 with the toner on its peripheral surface. Then, the transferring device 5 transfers the visible image, that is, the image formed of the toner (developer), onto a sheet of recording medium such as paper, or an intermediary transfer belt as an intermediary transferring member. In a case where the design of the image forming apparatus is such that the toner image is to be transferred onto the intermediary transferring member, the toner image is transferred onto a sheet of recording medium such as paper, from the intermediary transferring member. After the transfer of the toner image onto the sheet of recording medium, the toner image is subjected to heat and pressure by the fixing device 7, whereby the toner is fixed to the sheet of recording medium. After the transfer of the toner image onto the sheet of recording medium or intermediary transferring member, a certain amount of toner remains on the peripheral surface of the photosensitive drum 1. The toner remaining on the peripheral surface of the photosensitive is a combination of the "transfer residual toner" and "stray toner". The combination is removed by the cleaning blade 61, and is recovered as waste toner into the collection container. The "transfer residual toner" means such toner that transfers from the toner container 44 onto the area (which will be referred to as "exposed area") of the photosensitive drum 1, across which an electrostatic latent image is formed, but, failed to be transferred onto a sheet of paper or the like after the toner image formation, therefore remaining on the exposed area of the peripheral surface of the photosensitive drum 1. The "stray toner" means such toner that transferred from the toner container 44 onto the area (which hereafter will be referred to as "unexposed area") of the image formation area of the peripheral surface of the photosensitive drum 1, other than the exposed area, and adhered to the unexposed area. The stray toner is generated because when toner is frictionally charged while the toner layer of the development sleeve 41 is regulated in thickness by the development blade 42, a certain amount of toner is charged to the opposite polarity from the normal polarity. Since the stray toner is opposite in polarity from the normally charged toner, it does not transfer onto a sheet of paper or the like. Therefore, it remains on the photosensitive drum 1 after the image transfer onto the sheet or paper or the like.

Next, the general concept of how the amount of the waste toner is calculated by the image forming apparatus in this embodiment is described. Here, the waste toner amount is the amount of the toner (developer) removed from the peripheral surface of the photosensitive drum 1 by the cleaning blade 61 and recovered into the collection container 62. That is, in the first embodiment, the waste toner amount is the sum of the transfer residual toner amount and stray toner amount. The transfer residual toner amount is the amount of the toner which was not transferred onto a sheet of paper or the like after the toner image formation on the photosensitive drum 1, and is remaining on the exposed area of the image formation area of the photosensitive drum 1 after the toner image transfer. The stray toner amount is the amount of the toner which transferred onto the unexposed area of the image formation area of the photosensitive drum 1 from the toner container 44, and adhered thereto. Hereafter, the amount by which the toner transferred onto the photosensitive drum 1 from the toner container 44 will be referred to as toner consumption amount. The amount by which the toner transferred onto the exposed area of the photosensitive drum 1 from the toner container 44 will be referred to as the development toner amount. Thus, the toner consumption amount can be expressed as the sum of the development toner amount and stray toner amount. Further, the amount by which the development toner is transferred from the exposed area of the photosensitive drum 1 onto a sheet of paper or the like to form an image on the sheet of paper or the like, will be referred to as the image formation toner amount, and the amount of the toner which failed to be transferred onto a sheet of paper or the like after the toner image formation on the photosensitive drum 1, and is remaining on the exposed area of the photosensitive drum 1 after the toner image transfer, will be referred to as the transfer residual toner amount. Thus, the waste toner amount can be obtained by calculating the difference between the toner consumption amount and image formation toner amount. The image forming apparatus in the first embodiment has a first calculating means that calculates the toner consumption amount, and a second calculating means that calculates the image formation toner amount. Further, the image forming apparatus has a computing means that obtains the waste toner amount based on the toner amount calculated by the first calculating means, and the toner amount calculated by the second calculating means. In this embodiment, the roles of the first and second calculating means, and computing means, are played by the CPU 9 of the image forming apparatus.

Figure 3:
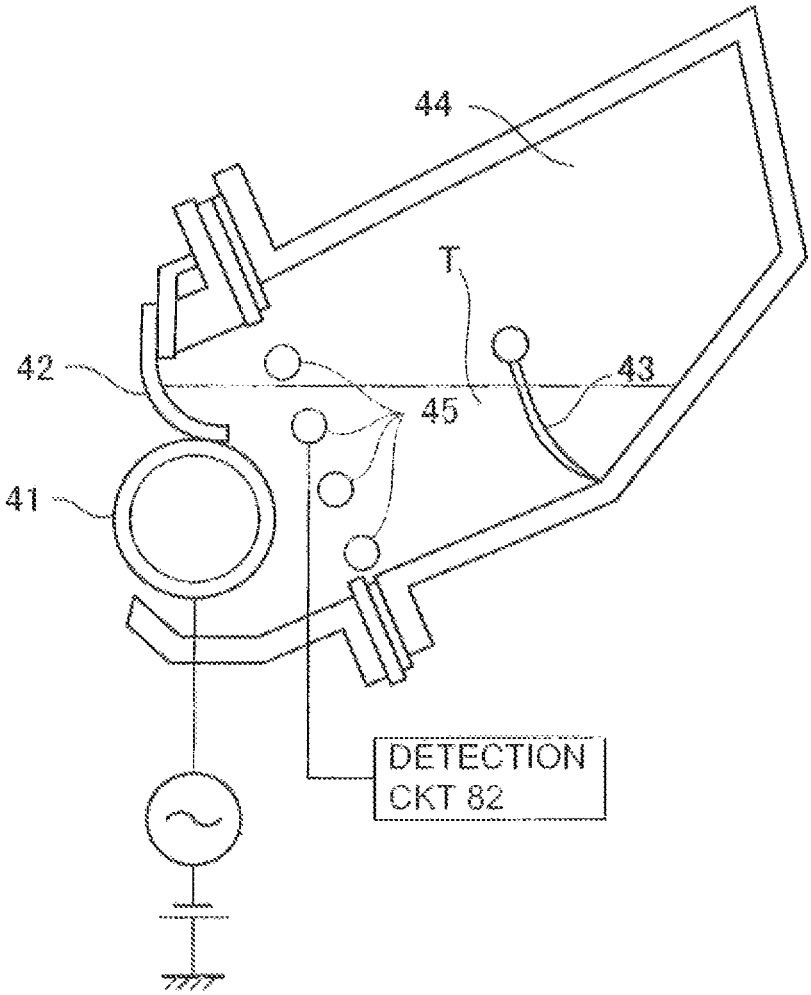
FIG. 3 is a schematic drawing for describing the method for detecting the residual amount of the toner in the toner container of the image forming apparatus, in the first embodiment.
Figure 5:
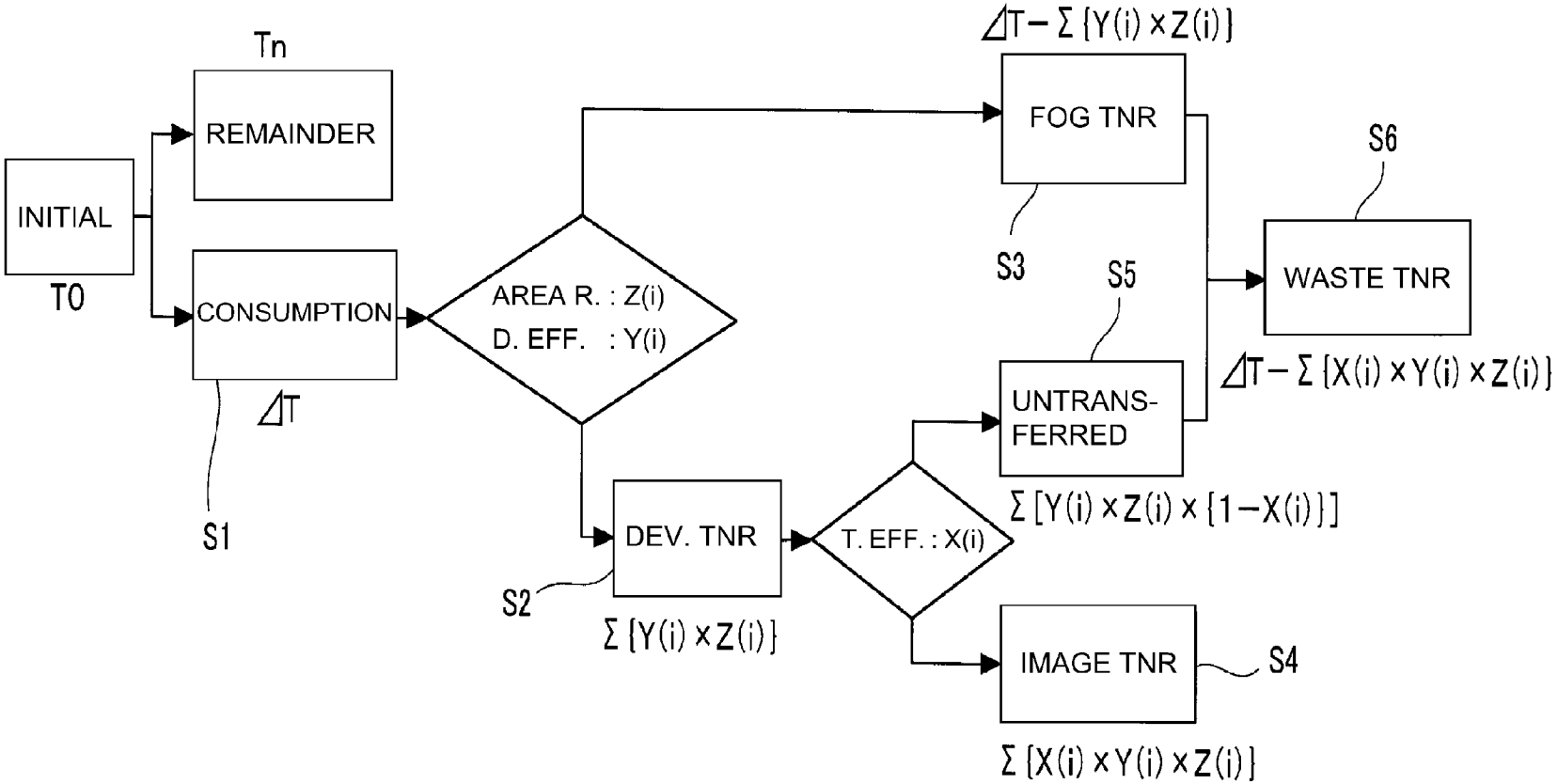
FIG. 5 is a tree diagram of the process for calculating the amount of the waste toner, based on the initial amount of the toner in the toner container.

In order to calculate the toner consumption amount, the amount of the toner in the toner container 44 (which hereafter will be referred to as residual toner amount) has to be obtained. In this embodiment, the image forming apparatus is equipped with a device for measuring the amount of the toner in the toner container 44. More concretely, the device is made up of an electrode 45, which is in the form of an antenna, and a detection circuit 82. Next, referring to FIG. 3, the method for detecting the amount of the residual toner in the toner container 44 with the use of the antenna (electrode) 45 is described. FIG. 5 is a drawing for describing the method, in the first embodiment, for detecting the residual toner amount in the toner container 44. As shown in FIG. 3, there are antennas 45 (electrodes) between the development sleeve 41 and the top wall of the toner container 44. The amount of electrostatic capacity between each antenna 45 and development sleeve 41 is affected by the ratio between the body of toner and body of air between the development sleeve 41 and antenna 45. Thus, the change in the amount of the electric current induced in the antenna 45 by the alternating bias applied to the development sleeve 41 is detected as change in the amount of voltage by the detection circuit 82 with which the developing device 41 is provided. With the use of this method, the residual toner amount in the toner container 44 can be almost continuously detected. Further, the amount of electrostatic capacity between the development sleeve 41 and antenna 45 is detected by a detection circuit (unshown) in advance, and is used as the referential amount for the electrostatic capacity between the development sleeve 41 and antenna 45. The amount of the voltage outputted by this detection circuit is compared to the amount of voltage outputted by the detection circuit 82 to determine the amount of the toner in the toner container 44.

Figure 4:
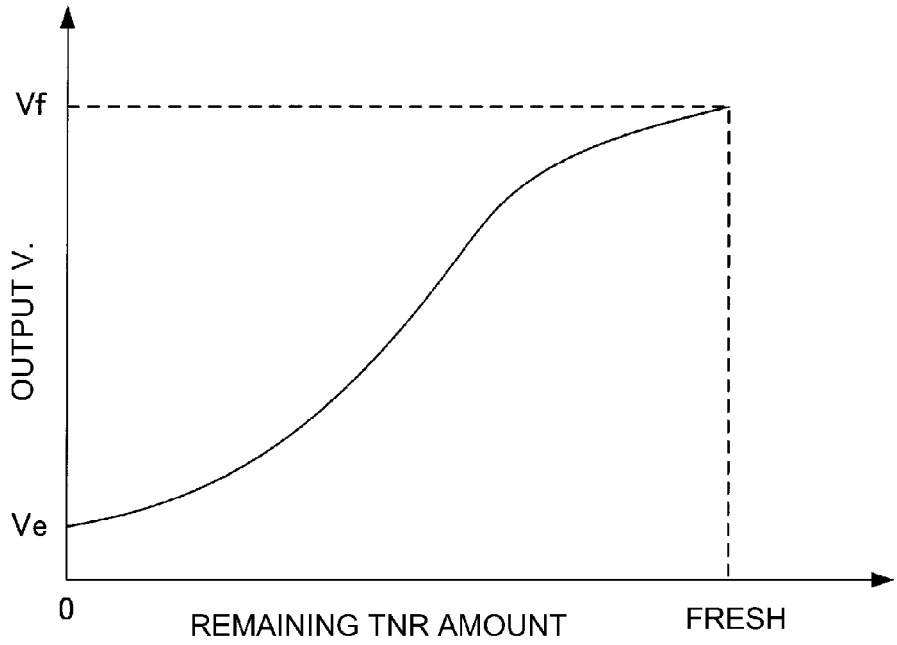
FIG. 4 is a graph showing the relationship between the residual amount of toner in the toner container, and the magnitude of the voltage outputted by the detection circuit, in the first embodiment.

Next, referring to FIG. 4, the relationship between the residual toner amount and the voltage outputted by the detection circuit is described. FIG. 4 is a graph showing the relationship between the residual toner amount in the toner container 44 and the output voltage of the detection circuit. As the amount of the toner in the toner container 44 gradually reduces, the output voltage of the detection circuit reduces, as shown in FIG. 4. Also referring to FIG. 4, in the first embodiment, Vf stands for the amount of the output voltage of the detection circuit when the process cartridge B is brand-new. As the toner in the toner container 44 transfers onto the photosensitive drum 1, the amount of the toner in the toner container 44 gradually reduces. As the output voltage reduces to Ve which stands for the referential value for the output voltage, it is determined that there is no toner left in the toner container 44. The process cartridge B in the first embodiment is provided with a total of four antennas (electrodes), making it possible to almost continuously determine the amount of the toner in the toner container 44 from when the process cartridge B is brand-new to when the process cartridge B runs out of the toner.

Next, the method for adjusting image forming apparatus in this embodiment in the halftone density is described. As the image forming apparatus in this embodiment is requested by a user to output images, the density data i for each picture element can be obtained from the image data by the image processing section of the image forming apparatus. Then, the control section 9 of the image forming apparatus creates an exposure pattern which reflects the density data i, and controls the exposing device 3 during an image forming operation. However, even if the exposure pattern remains the same, the halftone density of the image formed on recording medium is affected by various factors, for example, the non-uniformity in the sensitivity of the photosensitive drum 1, thickness of the dielectric layer of the photosensitive drum 1, etc., and also, the changes in chargeability and fluidity of the toner, which are attributable to the phenomenon that the external toner additive is buried into toner particles, and/or becomes separated from toner particles. Therefore, the image forming apparatus in this embodiment is adjusted in halftone density with preset interval, in order to keep the apparatus stable in halftone density.

The method for adjusting the image forming apparatus in this embodiment in halftone density is as follows: During an image forming operation, multiple test images which are different in exposure pattern are formed on multiple sheets of recording medium, one for one, for every preset number of prints. Then, the test images are measured in density with the use of a density measuring device 8 made up of a light emitting element, a light sensing element, and a detection circuit. The density measuring device projects a beam of light upon the test image with the use of its light emitting element, and catches the light reflected by the test image, with the use of its light sensing element. Then, it converts the amount of electric charge generated by the light sensing element, into voltage by its detection circuit, and outputs the voltage to the computing means. The computing means converts the value of the voltage from the detection circuit, into density, with reference to a conversion table prepared in advance. Since the amount of electric charge generated by the light sensing element is proportional to the density of the test image, it is possible to obtain the correlation between the exposure pattern and the test image. That is, by forming the test image on recording medium through the processes of exposure, development, and transfer, and detecting density of the test image (toner image) with the use of the light sensing element, it is possible to obtain the relationship among the transfer efficiency X(i), development efficiency Y(i), exposure area ratio Z(i), relative to the density data i. Here, the exposure area ratio Z(i) means the ratio of the area of a given picture element, which needs to be exposed to form an image according to the density data i, relative to the entire area of the picture element. The development efficiency Y(i) means the amount by which the toner is supplied to the exposed area to form an image according to the density data i. The transfer efficiency X(i) is the ratio with which the toner on the photosensitive drum 1 is transferred onto a sheet of paper or the like when the density data is i.

In this embodiment, the test images are formed with the tone set at nine different levels in terms of exposure area ratio. The image outputted with the exposure area ration set to Z(i) is measured in density, to obtain the product X(i)×Y(i) of the transfer efficiency and development efficiency, which is stored in the first storing means of the memory m of the process cartridge B. During an image forming operation, the exposure area ratio Z(i), with which the peripheral surface of the photosensitive drum 1 is to be exposed is calculated with reference to the X(i)×Y(i) in the first storing means, and the exposing device 3 is controlled based on the thus obtained exposure area ratio Z(i).

Next, referring to FIG. 5, the method for deriving each of the toner consumption amount, development toner amount, image formation toner amount, stray toner amount, transfer residual toner amount, and waste toner amount is described. FIG. 5 is a tree diagram for describing the various bodies of toner, which derive from the initial body of toner (initial amount T0 of toner) in the toner container 44. First, the toner consumption amount is described. As described above, the toner consumption amount ΔT is calculated by determining the value of the residual toner amount Tn in the toner container 44 with the use of the antennas 45 in the toner container 44, and comparing the determined value with the value of the initial toner amount T0 stored in the memory m of the process cartridge B. More concretely, the toner consumption amount ΔT is the difference between the initial toner amount T0 and the residual toner amount Tn in the toner container 44. Therefore, it can be calculated with the use of an equation: ΔT=T0−Tn (Step S1).

The development toner amount is the sum of the products of the development efficiency Y(i) and exposure area ratio Z(i). Therefore, it can be expressed as Σ{Y(i)×Z(i)} (Step S2).

The stray toner amount is the difference between the development toner amount Σ{Y(i)×Z(i)} and toner consumption amount ΔT. Therefore, it can be expressed as ΔT−Σ{Y(i)×Z(i)} (Step S3).

The image formation toner amount is the product of the development toner amount Σ{Y(i)×Z(i)} and transfer efficiency X(i). Therefore, it can be expressed as Σ{Y(i)×Z(i)}×Z(i) (Step S4).

The transfer residual toner amount is the difference between the development toner amount Σ{Y(i)×Z(i)} and image formation toner amount Σ{Y(i)×Z(i)}×Z(i). Therefore, it can be expressed as Σ[Y(i)×Z(i)×{1−X(i)}] (Step S5).

Next, the specific method used by the image forming apparatus in this embodiment for calculating the waste toner amount is described. When the density data is i, the waste toner amount is the sum of the stray toner amount ΔT−Σ{Y(i)×Z(i)} and transfer residual toner amount Σ[Y(i)×Z(i)×{1−X(i)}]. Therefore, it can be expressed as ΔT−Σ{X(i)×Y(i)×Z(i)} (Step S6). That is, the waste toner amount can be obtained by calculating the difference between the toner consumption amount ΔT and image formation toner amount Σ{X(i)×Y(i)×Z(i)}.

Further, the image formation toner amount Σ{X(i)×Y(i)×Z(i)} is calculated using the product X(i)×Y(i) of the transfer efficiency and development efficiency, and the exposure area ratio Z(i), which are stored in the memory m for every image forming operation, and is added to the value of the image formation toner amount in the memory m so that the cumulative image formation toner amount is stored in the memory m. In the first embodiment, the toner consumption amount ΔT detected with the use of the aforementioned antennas 45 is compared with the cumulative image formation toner amount in the memory m, in order to obtain the waste toner amount. If the toner consumption amount ΔT is the same as the cumulative image formation toner amount Δt, it means that the entirety of the toner consumed from within the toner container 44 was used for image formation. If the toner consumption amount ΔT is greater than the cumulative image formation toner amount Δt, it means that the amount by which the toner was consumed from within the toner container 44 is greater than the cumulative image formation toner amount, that is, the total amount of the toner used for image formation and moved out of the image forming apparatus, and therefore, there is waste toner in the collection container 62. As described above, by calculating the difference between the toner consumption amount ΔT and cumulative image formation toner amount Δt, it is possible to obtain the amount of the waste toner recovered into the collection container 62.

Next, referring to FIG. 6(*a*), the changes in the toner consumption amount and cumulative image formation toner amount of the image forming apparatus in this embodiment are described. FIG. 6(*a*) is a graph showing the changes in the toner consumption amount and cumulative image formation toner amount of the image forming apparatus in the first embodiment. As shown in FIG. 6(*a*), the greater the cumulative number by which prints were outputted by the image forming apparatus, the greater the difference between the toner consumption amount ΔT and cumulative image formation toner amount Δt. This phenomenon occurs for the following reasons. That is, the external additives with which toner particles are coated are gradually buried into the toner particles and/or separated from the toner particles, by an image forming operation, which in turn make the toner gradually deteriorate. Consequently, the transfer residual toner, stray toner, etc., increase, causing thereby the toner consumption amount ΔT to be greater than the cumulative image formation toner amount Δt.

Next, referring to FIG. 6(*b*), the changes in the measured and calculated values of the waste toner amount of the image forming apparatus in the first embodiment are described. FIG. 6(*b*) is a graph showing the changes in the measured and calculated values of the waste toner amount of the image forming apparatus in the first embodiment. In the first embodiment, as the calculated value of the waste toner amount reaches a threshold value P, it is determined that the collection container 62 has just been filled up with the waste toner. Then, a user is warmed by a display 10 or the like of the image forming apparatus that the waste toner container 62 has just been filled up with the waste toner. That is, the CPU 9 outputs information signals, based on the developer amount calculated by the first calculating means, and the developer amount calculated by the second calculating means, so that a warning is displayed on the display 10 of the image forming apparatus. Referring to FIG. 6(*b*), the changes in the waste toner amount calculated by the image forming apparatus in the first embodiment are similar to the changes in the actually measured amount of the waste toner. That is, the waste toner did not spill from the waste toner container 62 when the calculated waste toner amount reached the capacity (threshold value) of the waste toner collection container 62. In comparison, in the case of the conventional waste toner amount calculating method, that is, a waste toner amount calculating method which does not take the stray toner amount into consideration, the difference between the calculated (estimated) amount of the waste toner and the actual amount of the waste toner substantially increased as the cumulative number of prints increased. Consequently, by the time the calculated (estimated) amount of the waste toner reached the threshold value, the waste toner had began to spill from the waste toner container 62. Incidentally, the threshold P was set to a value which is slightly smaller than the capacity of the waste toner container 62.

As described above, the waste toner amount calculated by the image forming apparatus in the first embodiment is the sum of the transfer residual toner and stray toner amount. Therefore, the apparatus can accurately predict when the waste toner container 62 will be filled up with the waste toner. Therefore, a user is reliably warned that the waste toner container 62 of the image forming apparatus is about to be filled with the waste toner. Therefore, the image forming apparatus can be prevented from outputting unsatisfactory images, the flaws of which are attributable to the spilling of the waste toner from the waste toner collection container of the apparatus.

Embodiment 2

Next, referring to FIG. 7, the image forming apparatus in the second embodiment of the present invention is described. The second embodiment is different from the first embodiment, only in terms of the device for measuring the amount of the toner in the toner container. More concretely, the image forming apparatus in the second embodiment is provided with an optical device for detecting the residual amount of toner in the developer (toner) container 44. The optical device determines the amount of the toner in the developer (toner) container by detecting the beam of light projected into the developer container. FIG. 7 is a drawing for describing the method used by the image forming apparatus in the second embodiment to detect the residual amount of toner in the developer container. The image forming apparatus in the second embodiment cannot continuously detect the residual toner amount in the developer container. Here, therefore, a means for predicting when the waste toner collection container 62 will be filled up with the waste toner, even if the waste toner amount cannot be continuously calculated, is described. Also in the second embodiment, the transfer efficiency X(i), development efficiency Y(i), and exposure area ratio Z(i) are calculated based on the density data i, through the halftone density adjustment process, as in the first embodiment. That is, the image formation toner amount is calculated for each image forming operation, and the calculated image formation toner amount is added to the value in the memory m, so that the cumulative image formation toner amount Δs is stored in the memory m. In the following description of the second embodiment, the components, portions thereof, etc., of the image forming apparatus, which are similar to the counterparts in the first embodiment will not be described.

Referring to FIG. 7, the toner container 44 of the image forming apparatus in the second embodiment is provided with a light entry window 46 and a light exit window 47, which are positioned so that they squarely oppose each other across the toner container 44. Further, one of the side walls of the toner container 44 is provided with a light guide (unshown). A beam of light as detection light is projected upon the light guide from a light emitting element (unshown), so that the beam of light (detection light) enters the toner container 44 through the light entry window 46. As the beam of light (detection light) comes out of the light exit window 47, it is caught by the light sensing element (unshown). When the top surface H of the body of toner T in the toner container 44 is higher than the straight line between the light entry window 46 and light exit window 47, the beam of light (detection light) is blocked (or diffused) by the body of toner T, and therefore, the beam of light is not detected (caught) by the light sensing element. When the body of toner T is in this condition, it is determined that the amount of the toner T in the toner container is sufficient for image formation. On the other hand, when the top surface H of the body of toner T is lower than the straight line between the light entry window 46 and light exit window 47, a condition in which the beam of light (detection light) is not scattered by the toner, and therefore, the toner detection light is detected by the light sensing element, occurs at a frequency which is equal to the frequency of the rotation of the stirring/conveying member. In this condition, it is determined that the residual toner amount in the toner container 44 is rather small (This condition will be referred to as "low-toner condition"). As described above, a toner amount detecting device which uses a beam of light to detect the presence of toner cannot continuously detect the residual toner amount in the toner container 44.

Next, the method used by the image forming apparatus in the second embodiment to predict when the waste toner collection container 62 will be filled up with the waste toner is described. As the low-toner condition is detected by the above described toner amount detecting device which uses a beam of light to detect the presence of toner, the CPU 9 reads the cumulative amount ΔT of the image formation toner in the memory m of the process cartridge B. The toner consumption amount ΔS, which is the difference between the initial toner amount T0 stored in advance in the memory m of the process cartridge B, and the toner amount Tn which is the amount of toner in the toner container 44 in the low-toner condition. Thus, the waste toner amount in the low-toner condition can be calculated by subtracting the cumulative image formation toner amount Δs from the toner consumption amount ΔS. Further, the CPU 9 reads the cumulative number of the prints outputted before the low-toner condition occurred, from the second storing means of the memory m, and calculates the amount by which the waste toner is accumulated in the collection container 62 per print (which hereafter will be referred to as "waste toner accumulation speed"), based on the waste toner amount and cumulative number of the print. Then, it estimates the amount by which the waste toner can be continuously recovered into the collection container 62, based on the preset waste toner capacity of the collection container 62 and the calculated waste toner amount. Then, it predicts how many prints can be outputted before the collection container 62 is filled up with the waste toner, by dividing the estimated amount by which the waste toner is recoverable into the collection container 62 before the container 62 is filled up with the waste toner, with the waste toner accumulation speed. Then, it informs a use how many prints can be outputted before the collection container 62 is filled up with the waste toner.

TABLE 1

| Waste toner amount in low-toner condition | No. of Prints in-low toner condition | Waste toner accumulation speed up to low-toner condition | Predicted No. of prints up to full-state of collection container |
|---|---|---|---|
| 3 g | 4000 sheets | 0.75 mg/sheet | 6000 sheets |
| 4 g | 4000 sheets | 1.00 mg/sheet | 5000 sheets |
| 5 g | 4000 sheets | 1.25 mg/sheet | 4000 sheets |

Table 1 shows the waste toner amount in the collection container 62 of the image forming apparatus, the waste toner capacity of which is 5 g, right after the occurrence of the low-toner condition, and the estimated number by which prints can be outputted by the image forming apparatus before the collection container 62 will be filled up with the waste toner. In the experiment carried out to create Table 1, in order to change the waste toner amount, the development bias was intentionally set to increase the stray toner amount, instead of using the normal development bias. Referring to Table 1, if the amount of the waste toner in the collection container 62 is 3 g in the low-toner condition, a space large enough for 2 g of waste toner remains in the collection container 62. Therefore, it can be predicted that 6,000 prints will have been outputted before the collection container 62 runs out of the space for the waste toner, assuming that the speed with which the waste toner is accumulated in the collection container 62 after the occurrence of the low-toner condition remains the same as that before the occurrence of the low-toner condition. Therefore, the CPU 9 informs a user that 2,000 more prints can be outputted before the collection container 62 is filled up with the waste toner. In comparison, if the amount of the waste toner in the collection container 62 is 5 g in the low-toner condition, it is highly possible that the image forming apparatus will output unsatisfactory images, the flaws of which are attributable to the overfilling of the collection container 62 with the waste toner. Therefore, a user is prompted to replace the process cartridge B. Incidentally, in the second embodiment, when the collection container 62 will be filled up with the waste toner is predicted by storing the cumulative number by which prints were outputted, and calculating the waste toner accumulation speed from the cumulative print count. However, when the collection container 62 will be filled up with the waste toner can be predicted with the use of a parameter other than the cumulative print count. For example, it can be predicted with the use of cumulative length of the rotation of the photosensitive drum 1 or development sleeve 41, which indicates the history of the usage of the process cartridge B.

As described above, the image forming apparatus in the second embodiment can calculates the waste toner amount which is the sum of the transfer residual toner and stray toner amount. Therefore, it can accurately predict when its collection container will be filled up with the waste toner. Although it cannot continuously detect the residual toner amount in its toner container, and therefore, cannot continuously detect the waste toner amount, it can predict when its waste toner collection container will be filled up with the waste toner. Thus, it can issue a warning that the collection container is about to be filled up with the waste toner, and therefore, can be prevented from outputting unsatisfactory images, the flaws of which are attributable to the overflowing of the waste toner from the collection container.

Incidentally, reducing the collection container 62 in waste toner capacity reduces the length of time it takes for the container 62 to be filled up with the waste toner, and therefore, requires that when the container 62 will be filled up with the waste toner has to be more accurately predicted. That is, the second embodiment of the present invention is more effective when it is applied to a smaller collection container (62) than when it is applied to a larger collection container (62).

(Miscellanies)

In the case of the image forming apparatus in this embodiment, the CPU 9 issues the above described warning on the display of the image forming apparatus, in response to the detection signals. However, this embodiment is not intended to limit the present invention in terms of how and where the warning is issued. For example, the warning may be displayed on a terminal which is in connection to the image forming apparatus through a network, and/or the on-going image forming operation may be stopped, in response to the detection signals.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 175785/2011 and 133148/2012 filed Aug. 11, 2011 and Jun. 12, 2012, respectively, which are hereby incorporated by reference.

What is claimed is:

1. An image forming apparatus comprising:

an image bearing member;

a developing device including a developer container for containing a developer, and a developer carrying member for forming a developed image on said image bearing member based on an electrostatic latent image;

a transferring device for transferring the developed image onto a recording material;

a cleaning device including a cleaning member for removing the developer remaining on said image bearing member after transfer of the developed image and including a collection container for collecting the developer removed by said cleaning member;

a measuring device for measuring an amount of the developer in said developer container;

first calculating means for calculating an amount of the developer supplied from said developer container to said image bearing member;

second calculating means for calculating an amount of the developer transferred onto the recording material; and a controller for outputting an information signal relating to a developer amount accumulated in said collection container on the basis of a first amount of the developer calculated by said first calculating means and a second amount of the developer calculated by said second calculating means, wherein said first calculating means calculates a first amount of the developer supplied to said image bearing member from an inside of said developer container, on the basis of an amount of the developer in said developer container as measured by said measuring device after an image forming operation and an amount of the developer initially contained in said developer container, and said controller outputs the information signal relating to the developer amount accumulated in said collection container on the basis of the first amount of the developer calculated by said first calculating means and the second amount of the developer calculated by said second calculating means.

2. An apparatus according to claim 1, wherein said measuring device includes electrodes on said developer container, and measures the amount of the developer present in said developer container by measuring an electrostatic capacity between the electrodes.

3. An apparatus according to claim 1, wherein said measuring device measures the amount of the developer present in said developer container by detecting light passing through said developer container.

4. An apparatus according to claim 1, further comprising first storing means for storing beforehand a product of an area of a region of a pixel in which the electrostatic latent image is formed on the image bearing member to provide a predetermined density, an amount of the developer supplied to the region to provide the predetermined density, and a ratio of the developer which is transferred, wherein said second calculating means calculates the amount of the transferred developer by calculating a total sum of products of said area of said aforementioned product.

5. An apparatus according to claim 1, further comprising a first storing means for storing a use state of the image forming apparatus, wherein on the basis of the use state, an average of the accumulated amount in said collection container is calculated for each image formation, and on the basis of the average and a free space of said collection container in the use state, a number of recording materials on which images are capable of being formed until said collection container becomes full of the developer is predicted.

6. An apparatus according to claim 1, further comprising a display portion for displaying information for displaying a warning on the basis of the information signal.

7. An apparatus according to claim 1, wherein said controller stops an operation of the image formation of said image forming apparatus on the basis of the information signal.

8. An apparatus according to claim 1, further comprising an exposure device for forming the electrostatic latent image on said image bearing member by exposure to light.

9. An apparatus according to claim 1, wherein an amount of waste toner is calculated on the basis of an amount of fog toner and an amount of residual toner after the image transfer.

10. An apparatus according to claim 9, wherein the amount of fog toner is calculated on the basis of the first amount.

11. An apparatus according to claim 9, wherein the amount of the residual toner after the image transfer is color graded on the basis of the second amount.

12. An image forming apparatus comprising:

an image bearing member;

a developing device including a developer container for containing a developer, and a developer carrying member for forming a developed image on said image bearing member;

a transferring device for transferring the developed image onto a recording material;

a cleaning device including a cleaning member for removing the developer remaining on said image bearing member and including a collection container for collecting the developer removed by said cleaning member;

a measuring device for measuring an amount of the developer in said developer container; and a controller for outputting an information signal relating to a developer amount accumulated in said collection container on the basis of a first amount of developer supplied from said developer container to said image bearing member and a second amount of developer transferred onto the recording material, wherein the first amount of the developer is determined on the basis of an amount of the developer measured by said measuring device after an image forming operation and an amount of the developer initially contained in said developer container, and wherein the second amount of the developer is determined on the basis of a development developer amount and a transfer efficiency.

13. An apparatus according to claim 12, wherein an amount of waste toner is calculated on the basis of an amount of fog toner and an amount of residual toner after the image transfer.

14. An apparatus according to claim 13, wherein the amount of fog toner is calculated on the basis of the first amount.

15. An apparatus according to claim 13, wherein the amount of the residual toner after the image transfer is color graded on the basis of the second amount.

16. An apparatus according to claim 12, wherein said measuring device includes electrodes on said developer container, and measures the amount of the developer present in said developer container by measuring an electrostatic capacity between the electrodes.

17. An apparatus according to claim 12, wherein said measuring device measures the amount of the developer present in said developer container by detecting light passing through said developer container.

18. An apparatus according to claim 12, further comprising first storing means for storing beforehand a product of an area of a region of a pixel in which an electrostatic latent image is formed on the image bearing member to provide a predetermined density, an amount of the developer supplied to the region to provide the predetermined density, and a ratio of the developer which is transferred, wherein the amount of the transferred developer is calculated by calculating a total sum of products of the area of said aforementioned product.

19. An apparatus according to claim 12, further comprising a first storing means for storing a use state of the image forming apparatus, wherein on the basis of the use state, an average of the accumulated amount in said collection container is calculated for each image formation, and on the basis of the average and a free space of said collection container in the use state, a number of recording materials on which images are capable of being formed until said collection container becomes full of the developer is predicted.

20. An apparatus according to claim 12, further comprising a display portion for displaying information for displaying a warning on the basis of the information signal.

21. An apparatus according to claim 12, wherein said controller stops an operation of the image formation of said image forming apparatus on the basis of the information signal.

* * * * *